US005487773A

United States Patent [19]

Seyama et al.

[11] Patent Number: 5,487,773

[45] Date of Patent: Jan. 30, 1996

[54] PROCESS FOR PRODUCING SINTERED BODY AND MAGNET BASE

[75] Inventors: Yoshihiko Seyama; Yutaka Shimizu, both of Kawasaki, Japan

[73] Assignee: Fujitsu Limited, Kawasaki, Japan

[21] Appl. No.: 317,361

[22] Filed: Oct. 4, 1994

Related U.S. Application Data

[62] Division of Ser. No. 961,857, Oct. 16, 1992, Pat. No. 5,393,484.

[30] Foreign Application Priority Data

Oct. 18, 1991 [JP] Japan ..... 3-269864

[51] Int. Cl.[6] ..... B22F 3/12; B22F 5/00

[52] U.S. Cl. ..... 75/228; 75/950; 428/682; 428/544

[58] Field of Search ..... 75/228, 950; 428/544, 428/611, 681, 900, 682

[56] References Cited

U.S. PATENT DOCUMENTS

| | | | |
|---|---|---|---|
| 4,562,092 | 12/1985 | Weich, Jr. | 427/58 |
| 4,602,952 | 7/1986 | Greene et al. | 75/228 |
| 4,602,956 | 7/1986 | Partlow et al. | 75/235 |
| 5,032,352 | 7/1991 | Meeks et al. | 419/8 |

FOREIGN PATENT DOCUMENTS

| | | |
|---|---|---|
| 0491950 | 7/1992 | European Pat. Off. . |
| 88/07901 | 10/1988 | WIPO . |

OTHER PUBLICATIONS

*Patent Abstracts of Japan,* vol. 15, No. 174, Jul. 6, 1989 & JP-A- 3-039405 (Mitsubishi Heavy Metal Ind KK), Feb. 20, 1991.

*Patent Abstracts of Japan,* vol. 15, No. 336, Aug. 20, 1991 & JP-A-3-130306 (Seiki Epson), Jun. 4, 1991.

Derwent Publications Ltd., London, GB; AN 91-349234 & JP-A-3 232906 (Daido Tokushoko KK), Oct. 16, 1991.

*Primary Examiner*—Ngoclan Mai
*Assistant Examiner*—Daniel J. Jenkins
*Attorney, Agent, or Firm*—Staas & Halsey

[57] ABSTRACT

A process for producing a sintered body, comprising inserting a separately formed first molded article in a mold for injection molding, injection-molding a material identical to or different from that of the first molded article in the mold so that the injected material and the first molded article form together a second molded article, degreasing the second molded article, sintering the degreased article thereby obtaining a sintered body having a difference in shrinkage during the sintering between the first molded article and the injection molded portion of the second molded article other than the first molded article portion being 5% or less. The resulting sintered body is useful as a magnet base.

3 Claims, 4 Drawing Sheets

PROCESS FOR PRODUCING SINTERED BODY AND MAGNET BASE

This application is a division of application Ser. No. 07/961,857, filed Oct. 16, 1992, now U.S. Pat. No. 5,393, 484.

BACKGROUND OF THE INVENTION

1. Field of the Invention

The present invention relates to a process for producing a composite sintered body, formed from materials that are the same or different, using a metal injection molding (hereinafter abbreviated to "MIM") method, or process.

2. Description of the Prior Art

In order to prepare a molded article with dimensional accuracy, it is a common practice to conduct a cutting operation. In some molded articles, however, the material is so hard or fragile that it is difficult to perform lathe machining.

Examples of such molded articles include magnet bases and yokes of motors formed using a soft magnetic material comprising an iron-silicon (Fe—Si) alloy and an iron-cobalt (Fe—Co) alloy. In these articles, since the material is hard and fragile, the production yield when cutting is low, which renders these materials unsuitable for practical use.

In this connection, there is a metal injection molding method (MIM method) that comprises mixing a metallic powder with an organic binder, subjecting the mixture to injection molding in a necessary shape, placing the resultant molded article in a furnace wherein the temperature is gradually raised to remove the organic binder through the decomposition of the binder, and raising the temperature of the molded article from which the binder has been removed, thereby sintering the molded article.

This method is characterized in that it is suitable for working a material of the type described above and is applicable to a molded article having a complicated shape, and affords a high yield.

In some metallic components prepared by the MIM method, from the viewpoint of properties and cost, it is preferable that, depending upon applications, the components do not comprise a single material.

For example, in a magnet base for a wire dot printer, it is not always necessary that a core portion, wherein a coil is wound and a current is applied so as to generate a magnetic flux, comprise a material identical to that constituting a yoke portion used for forming a magnetic flux path; from the viewpoint of properties and cost; it is preferable that the core portion comprise a material different from that constituting the yoke portion.

When a sintered body having a protrusion and a thick-wall portion is formed by the MIM method, deformation is liable to occur in the protrusion while cracking or blistering is liable to occur in the thick-walled portion. In this case, a sintered body can be produced with a good yield by forming a protrusion or a thick-walled portion by powder compression molding, placing the formed protrusion or thick-walled portion in a mold and then applying the MIM method.

The present invention relates to a process for producing the above-described composite sintered body.

The process for sintering an injection molded article comprises four steps, that is, the step of kneading raw materials, the step of injection molding, the step of removing the binder and the step of sintering.

Specifically, a metallic powder having a mean particle diameter of 10 μm or less is well (i.e., thoroughly) kneaded with an organic binder such as paraffin wax, and a pressure of about 1 ton/cm$^2$ is applied so as to conduct injection molding and provide a molded article.

Then, the molded article is heated to a temperature of about 400° C. in a non-oxidizing atmosphere, such as argon (Ar) or nitrogen ($N_2$), subjected to a treatment for removing the binder through the evaporation thereof, and then heated to a high temperature to conduct sintering.

In some components used in electronic equipment, it is preferable that the metallic components partly comprise different materials rather than a single material depending upon applications and shapes thereof.

In such applications, components have been prepared by preparing individual components by the MIM method and joining the components by means of screwing, soldering, diffusion joining or the like.

When such a method is applied, the shape, material, etc. of the joint are limited. In general, the bonding strength is weak, and the process steps are increased, which unfavorably cause problems such as increasing the production costs.

When a molded article having an uneven thickness comprising a thick-walled portion, a protrusion, a thin-walled portion, etc. is molded by injection molding and then sintered to give a sintered body, in the prior art, cracking or deformation is liable to occur, thereby lowering the production yield.

Accordingly, an object of the present invention is to improve the production yield.

Further, with respect to different materials, it is preferable to form a composite sintered body using the MIM method. In this case, cracking should not occur in the joint. Another object of the present invention is to provide a solution to this problem.

SUMMARY OF THE INVENTION

The above-described objects of the present invention can be attained by a process for producing a sintered body comprising inserting a separately formed, first molded article in a mold for injection molding, injection-molding a material identical to or different from that of the first molded article in the mold so that the injected material and the first molded article form a second molded article, while bringing the difference in shrinkage during the sintering between the material of the first molded article and that used for the injection molding at the formation of the second molded article to 5% or less, preferably 2% or less, e.g., through regulation of the grain size of the raw material powder and the amount of binder, degreasing the second molded article and sintering the degreased article.

DESCRIPTION OF THE PREFERRED EMBODIMENTS

Figure 1:
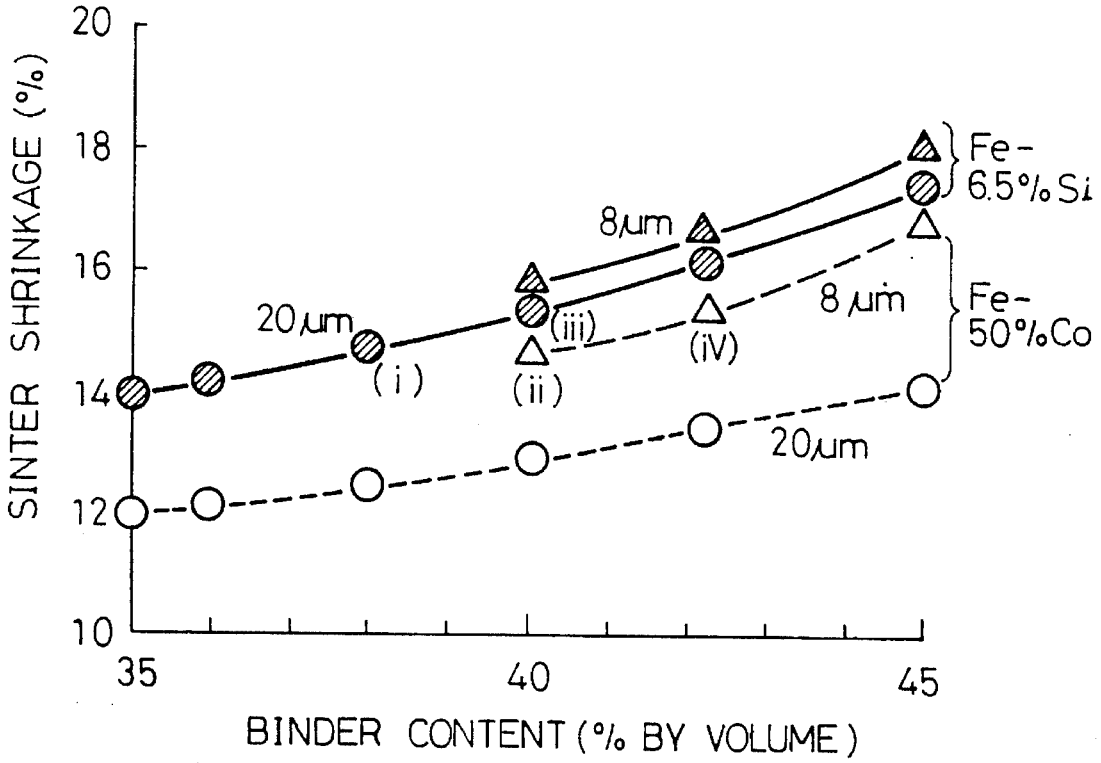
FIG. 1 is a graph showing a relationship between the binder content and the sintering shrinkage.

In the prior art, in the preparation of a sintered body using the MIM method, when a thick-walled portion, a protrusion, a thin-walled portion, etc. are present, cracking or blistering is liable to occur in the thick-walled portion, deformation is liable to occur in the protrusion and defective molding is liable to occur in the thin-walled portion, so that the production yield is unfavorably poor.

In the present invention, MIM is conducted in such a state that an article separately formed by powder compression molding is inserted into a position in a mold corresponding to a thick-walled portion and a position corresponding to a protrusion while an article, separately formed by green sheet molding, is inserted into a position corresponding to a thin-walled portion.

Specifically, cracking or blistering occurs because an unexpected decomposition occurs, owing to insufficient removal of the binder during the treatment for removing the binder. Therefore, the problem can be solved by a method wherein a compressed powder molded article, comprising a much lesser amount of binder than the injection molded article, is used in the thick-walled portion and the protrusion.

Further, since the occurrence of deformation is attributable to such a phenomenon that the shape cannot be maintained because of the softening of the binder, this problem can be solved by making use of a compressed powder molded article wherein the amount of addition of the binder is small and the binding force between powder particles is large.

Further, an injection molding material cannot be sufficiently filled into the thin-wall portion. This problem can be solved by conducting injection molding in such a state that a green sheet molded article is inserted into the mold position corresponding to the thin-walled portion.

When injection molding is conducted in such a manner that the compressed powder molded article or green sheet molded article is inserted into a part of the mold, a joint problem occurs. Since, however, injection molding is conducted under a pressure of about 1 ton/cm$^2$, both materials are completely joined to each other, so that no problem occurs.

A problem arises in a process wherein a sinter (i.e., a sintered article) is prepared by conducting a two step injection molding operation using different materials, degreasing the molded article and sintering the decreased article in that the resulting article is dependent on sintering shrinkage, which varies from material tó material, and which leads to the occurrence of cracking in the joint of the sinter.

For this reason, it is necessary to conform the sintering shrinkage of the different materials, relatively to each other. In the present invention, the occurrence of cracking is prevented by steps such that:

(1) the mean particle diameter of the powder and the amount of the binder are regulated;

(2) the molded article is formed with compositions which are stepwise or continuously varied.

The present invention will now be described with reference to an embodiment wherein use is made of an Fe-50% Co alloy having a very large saturated magnetic density and an Fe-6.5% Si alloy having an increased (i.e., relatively greater) magnetic permeability owing to an improvement in the magnetic properties of pure iron.

FIG. 1 is a graph showing a change in the sintering shrinkage in the case that use is made of two magnetic substances, respectively having mean particle diameters of 8 μm and 20 μm, injection molding is conducted with the binder content varying from 35% to 45% by volume, the binder is removed by bringing the maximum temperature of the molding to 435° C. and sintering is then conducted at 1400° C. in a $H_2$ gas stream for one hour.

From FIG. 1, it is apparent that the Fe-6.5% Si alloy exhibits a larger sintering shrinkage than the Fe-50% Co alloy and that the sintering shrinkage increases with a reduction in the mean particle diameter.

In the present invention, two materials that have similar sintering shrinkages are selected and their respective sintering shrinkages of the two materials are made to conform to each other.

For example, when injection molding is performed using an Fe-6.5% Si alloy (i) having a mean particle diameter of 20 μm and a binder content of 38% by volume and an Fe-50% Co alloy (ii) having a mean grain diameter of 8 μm and a binder content of 40% by volume, as raw materials, to provide a composite that is then sintered, the respective sintering shrinkages of the two materials become identical to each other (14.5%), so that the occurrence of cracking can be prevented.

Similarly, when injection molding is conducted using an Fe-6.5% Si alloy (iii) having a mean particle diameter of 20 μm and a binder content of 40% by volume and an Fe-50% Co alloy (iv) having a mean grain diameter of 8 μm and a binder content of 42% by volume, as raw materials, to provide a composite that is then sintered, the sintering shrinkages of the respective materials become identical to each other (15.5%), so that the occurrence of cracking can be prevented.

In practice, there is no need for the sintering shrinkages of both materials to conform to each other, and the difference in shrinkage may be 5% or less, preferably 2% or less. As is apparent from the description in the examples, which will be described later, when the difference in the sintering shrinkage is more than 5%, the probability of occurrence of cracking is approximately 100%, while when the difference in the sintering shrinkage is less than 2%, the probability of prevention of cracking is approximately 100%.

In the method wherein use is made of a gradually varied composition, when an Fe-50% Co alloy and an Fe-6.5% Si alloy are represented by articles A and B, respectively, the articles A and B are not directly joined to each other. In this case, injection molding is conducted a plurality of times so that the composition is stepwise and gradually varied as follows: 100% A/75% A+25% B/50% A+50% B/25% A+75% B/100% B (in this case, injection molding is conducted five times). Then, the binder is removed from the molded article, and the molded article is then sintered to yield a sintering body wherein the sintering shrinkage is gradually changed, which prevents the occurrence of cracking.

This method can advantageously prevent the occurrence of Kirkendall voids, derived from the diffusion of constituent atoms, and which thereby enables a high joining strength to be maintained.

The present invention will further be illustrated with reference to the following non-limitative examples.

EXAMPLE 1

Figure 2A:
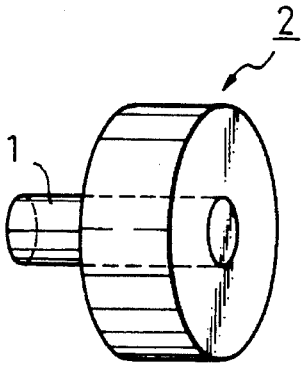
FIGS. 2A and 2B are perspective views of sintered bodies prepared in Examples 1 and 2.

(Example of use of a compressed powder molded article; in connection with FIG. 2A)

1% by weight of zinc stearate was mixed with an Fe-50% Co alloy powder having a mean particle diameter of 20 μm, and the mixture was subjected to compressed powder molding to form a cylindrical molded article 1 having a diameter of 5 mm and a length of 20 mm. The molding (i.e., the molded article) 1 was inserted into a mold for injection molding, an Fe-6.5% Si alloy powder having a mean particle diameter of 20 μm was mixed with 40% by volume of a polyethylene binder, and injection molding was conducted to form a composite molded article 2 having a diameter of 20 mm and a thickness of 5 mm as shown in FIG. 2A.

The molded article was heated at a maximum temperature of 435° C. to remove the binder and then sintered in a $H_2$ gas stream at 1400° C. for one hour. As a result, no unfavorable phenomena such as cracking, blistering and deformation were observed in the sintered body.

EXAMPLE 2

Figure 2B:
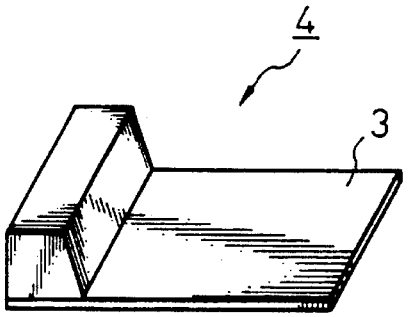

(Example using a green sheet molded article, in connection with FIG. 2B)

50 parts by weight of polybutyral as a binder, 15 parts by weight of dibutyl phthalate as a plasticizer and 400 parts by weight of methyl ethyl ketone as a solvent were added to 100 parts by weight of an Fe-50% Co alloy powder having a mean particle diameter of 20 μm, and kneading was conducted using a ball mill. The mixture was cast using the doctor blade method to a thickness of 1 mm to form a green sheet 3 50 mm×50 mm×1 mm.

The green sheet 3 was inserted into a mold for injection molding, an Fe-6.5% Si alloy powder having a mean particle diameter of 20 μm was mixed with 40% by volume of a polyethylene binder, and injection molding was conducted to form a composite molded article 4 as shown in FIG. 2 (B)

.

The molded article was heated at a maximum temperature of 435° C. to remove the binder and then sintered in a $H_2$ gas stream at 1400° C. for one hour. As a result, no unfavorable phenomena such as cracking, blistering and deformation were observed in the sintered body.

EXAMPLE 3

(Relationship between shrinkage during sintering and occurrence of cracking)

Figure 6:
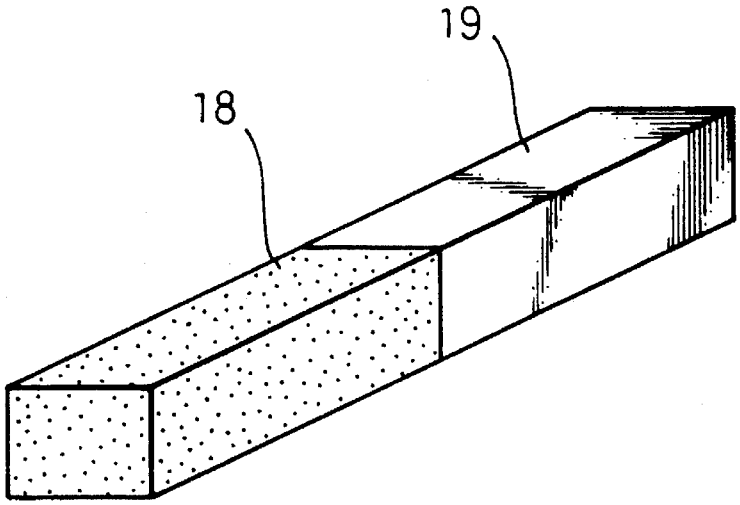
FIG. 6 is a perspective view of a sintered body prepared in Example 3.

Kneaded products wherein the shrinkage during sintering varied via the regulation of the mean particle diameter, and the binder content of the Fe-50% Co alloy and the Fe-6.5% Si alloy were prepared. An Fe-50% Co alloy portion was formed by injection molding and inserted into a mold, and an Fe-6.5% Si alloy was subjected to injection molding so as to prepare a molded article shown in FIG. 6. The molded article was degreased and sintered and subjected to a shrinkage measurement at the time of sintering the Fe-50% Co alloy portion 18 and the Fe-6.5% Si alloy portion 19, and it was determined whether or not cracking had occurred.

Figure 7:
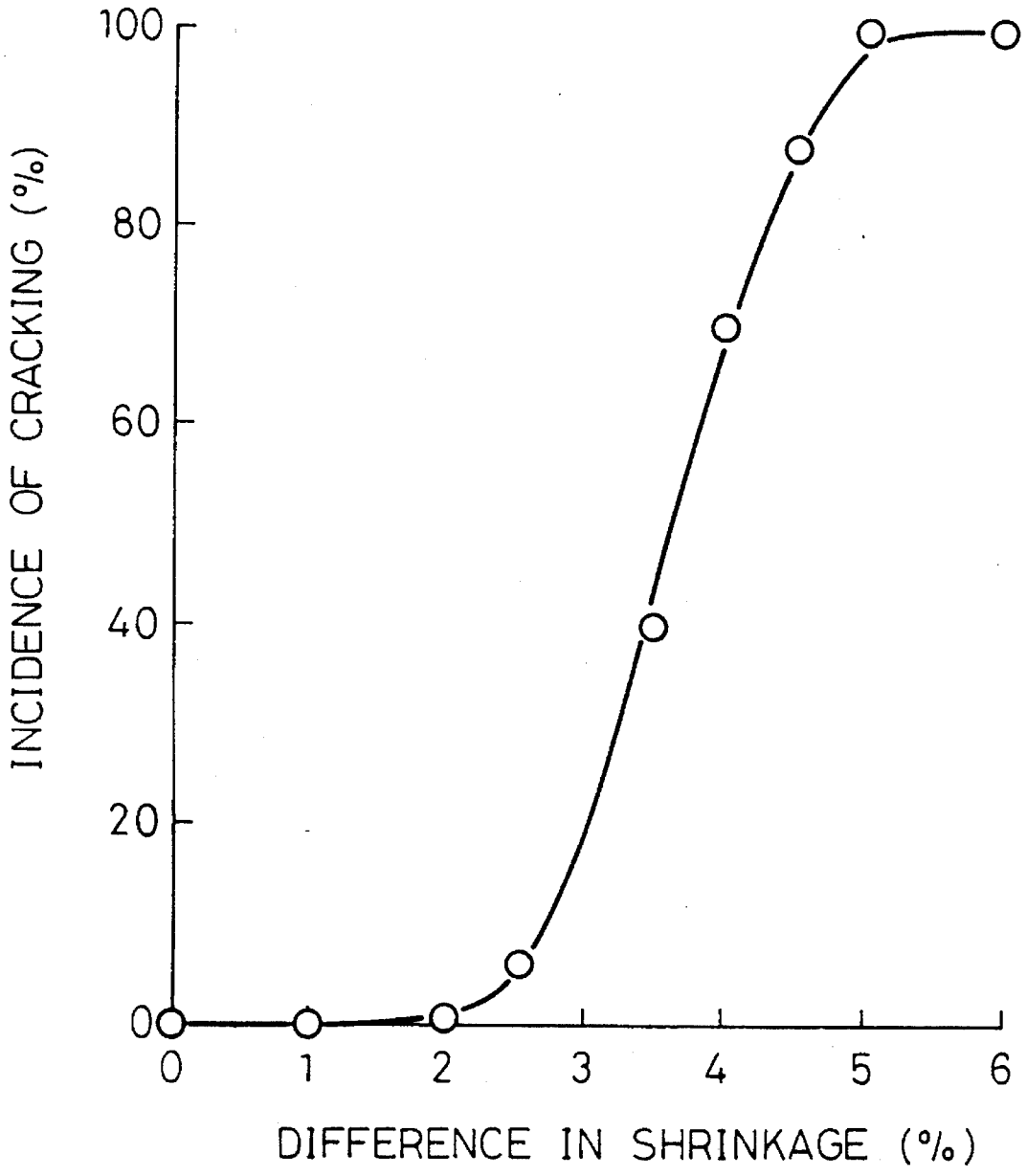
FIG. 7 is a graph showing a relationship between the difference in shrinkage during sintering and the incidence of cracking.

FIG. 7 is a graph showing the relationship between a difference in shrinkage at the time of sintering and the incidence of cracking. When the difference in shrinkage at the time of sintering is 5% or more, the probability of cracking occurring is 100%. Therefore, when a sintered body is prepared according to the process of the present invention, the difference in shrinkage at the time of sintering should be 5% or less. On the other hand, when the difference in shrinkage at the time of sintering is 2% or less, no cracking occurs. From this fact, the difference in shrinkage at the time of sintering is desirably 2% or less.

In Examples 1 and 2 as well, a similar experiment was conducted with the shrinkage at the time of sintering being varied via the regulation of the mean particle diameter and the binder content of the Fe-50% Co alloy and the Fe-6.5% Si alloy. As a result, the relationship between the difference in shrinkage at the time of sintering and the incidence of cracking was the same as that obtained in Example 3.

EXAMPLE 4

Figure 3:
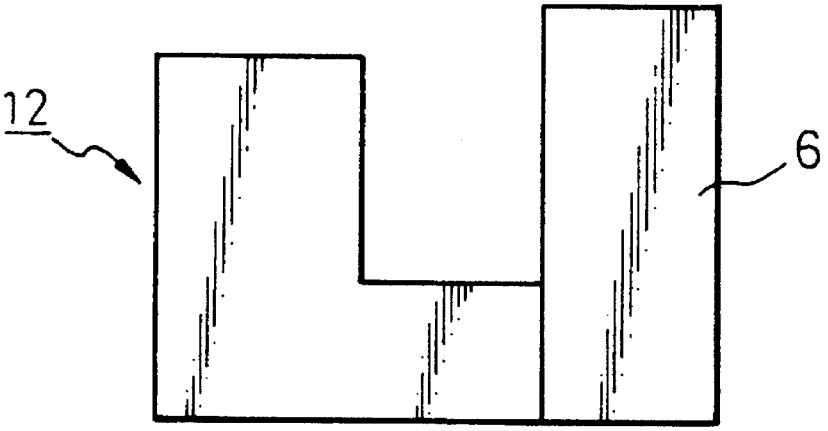
FIG. 3 is a cross-sectional view explaining Example 4.

(Example of application to magnet base for wire dot printer, in connection with FIG. 3)

Figure 5:
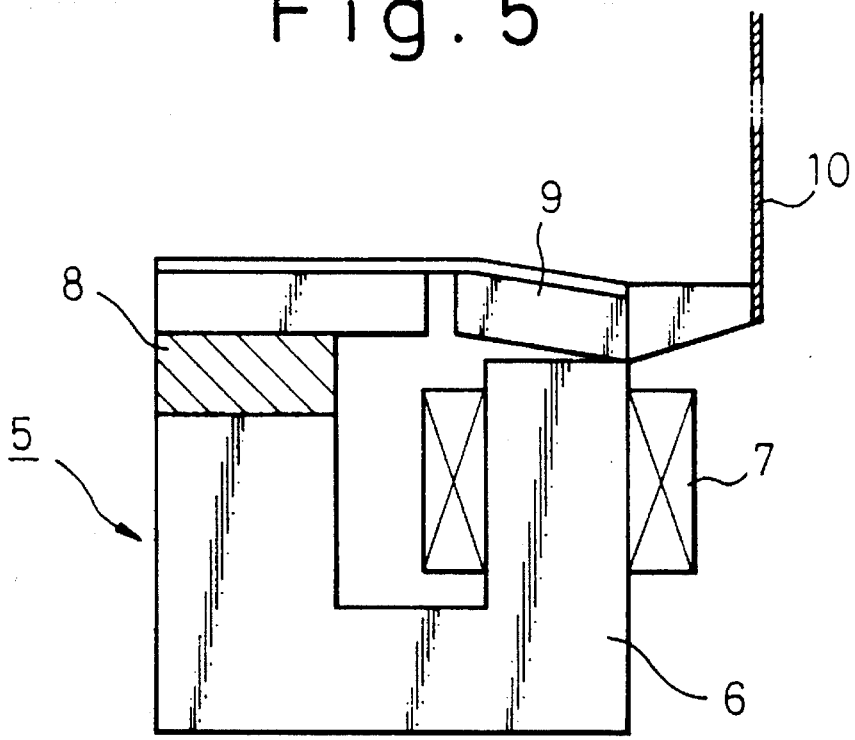
FIG. 5 is a sectional block diagram of a release type wire dot printer.

FIG. 5 is a cross-sectional view of a structure of a release type wire dot printer wherein a coil 7 is wound around a core 6 constituting a magnet base 5 to form an electromagnet.

A permanent magnet 8 is provided at one end of the magnet base 5 and always attracts an armature 9 with the magnet base 5 serving as a magnetic flux path. When the coil 7 is energized to generate a reverse magnetic field, the attraction of the armature 9 is eliminated, thereby causing a wire 10 to be projected and printing to be conducted.

In the prior art, the whole magnet base 5 comprises a sintered body comprised of an Fe-50% Co alloy.

However, the use of an Fe-50% Co alloy (specific gravity: 8.18) in the core 6 forming portion alone is sufficient, and the use of pure iron (specific gravity: 7.88) or an Fe-6.5% Si alloy (specific gravity: 7.49) having improved magnetic properties is sufficient in the other portion, that is, the magnet base portion (yoke portion). This contributes to a reduction in weight and a reduction in cost.

At the outset, an Fe-50% Co alloy powder having a mean particle diameter of 8 μm was kneaded with 40% by volume of a binder by means of a pressure kneading machine to provide a kneaded product.

Separately, an Fe-6.5% Si alloy powder having a mean particle diameter of 20 μm was kneaded with 38% by volume of a binder by means of a pressure kneading machine to provide a kneaded product.

The binder is based on polyethylene and composed mainly of polyethylene and polymethyl methacrylate (abbreviated to "PMMA") .

At the outset, the kneaded product comprising an Fe-50% Co alloy was subjected to injection molding to provide a molding for use as a core 6 portion shown in FIG. 3. The molding was inserted into a mold for injection molding, and the kneaded product comprising an Fe-6.5% Si alloy was injection-molded integrally with the core portion to provide a magnet base 12 comprising a composite molding.

The binder was removed from the magnet base at a maximum temperature of 435° C., and the magnet base was then sintered in a $H_2$ gas stream at 1400° C. for one hour. As a result, no unfavorable phenomena such as cracking, blistering and deformation were observed in the sinter.

The magnet base was incorporated in a printer, and a comparison was made on the printing speed. As a result, the printing speed was 111 cps and thus comparable to 110 cps, which was the printing speed when the conventional magnet base, comprised of a, sintered body of Fe-50% Co only, was used.

The weight of the magnet base was 130 g, whereas the magnet base of the present invention was a reduced value of 121 g. Further, the price of the raw material powder could be reduced by 40%.

EXAMPLE 5

Figure 4:
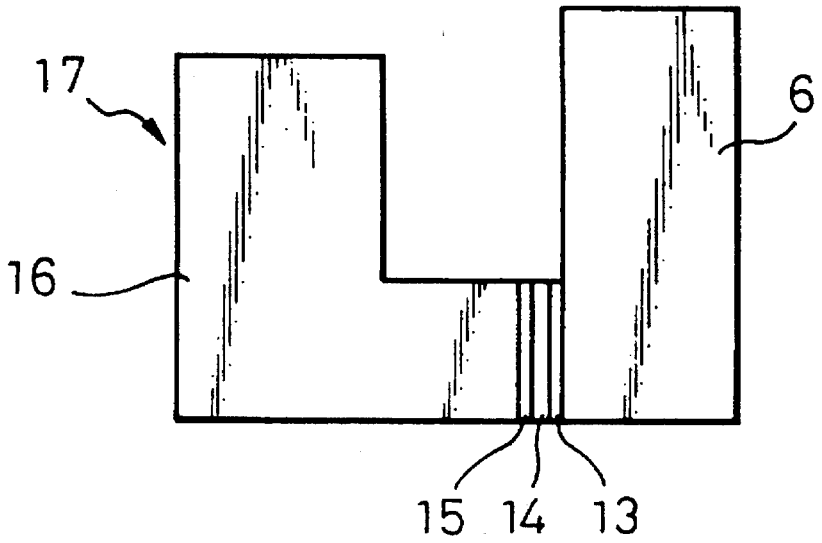
FIG. 4 is a cross-sectional view explaining Example 5.

(Example of application for formation of magnet base for wire dot printer, in connection with FIG. 4)

An Fe-50% Co alloy powder having a mean particle diameter of 20 μm and an Fe-6.5% Si alloy powder having a mean particle diameter of 20 μm were weighed, and the polyethylene binder was added in an amount of 40% by volume to prepare the following 5 kinds of material.

(1) 60% by volume (Fe-50% Co alloy system)+40% by volume (binder)

(2) 45% by volume (Fe-50% Co alloy system)+15% by volume (Fe-6.5% Si alloy system)+40% by volume (binder)

(3) 30% by volume (Fe-50% Co alloy system)+30% by volume (Fe-6.5% Si alloy system)+40% by volume (binder)

(4) 15% by volume (Fe-50% Co alloy system)+45% by volume (Fe-6.5% Si alloy system)+40% by volume (binder)

(5) 60% by volume (Fe-6.5% Si alloy system)+40% by volume (binder)

Then, kneading was conducted by means of a pressure kneading machine to provide a kneaded product.

At the outset, the kneaded product of the above material (1) comprising an Fe-50% Co alloy was injection-molded to prepare a molded article for use as a core 6 shown in FIG. 4, and the molded article was inserted into a separate mold for injection molding a magnet base. Then, the kneaded product of material (2) was injection-molded to prepare a layer 13 of material (2) having a thickness of 1 mm. This molding was inserted into a separate mold for injection molding a magnet base, and the kneaded product of material (3) was injection-molded into a layer 14 of material (3) having a thickness of 1 mm. Similarly, a layer 15 of material (4) having a thickness of 1 mm was formed, the molding was inserted into a separate mold for injection molding a magnet base, and the headed product of material (5) was injection-molded into a yoke portion 16, thereby forming a magnet base 17.

The binder was removed from the magnet base at a maximum temperature of 435° C. and sintered in a $H_2$ gas stream at 1400° C. for one hour. As a result, no unfavorable phenomena such as cracking, blistering and deformation were observed in the sintered body. Observation of the boundary portion under a microscope revealed that no Kirkendall void occurred.

EXAMPLE 6

(Example of application for formation of magnet base for wire dot printer)

A magnet base was formed in the same manner as that of Example 4, except that the material was changed.

Specifically, an Fe-50% Co alloy (sintering density: 95%) was used as the material for forming the core 6, and an Fe-50% Co alloy (sintering density: 86%) was used as the material for forming the other portion.

An Fe-50% Co alloy powder having a mean particle diameter of 8 μm was kneaded with 40% by volume of a binder by means of a pressure kneading machine to form a first headed product.

An Fe-50% Co alloy powder having a mean particle diameter of 30 μm was headed with 38% by volume of a binder by means of a pressure kneading machine to form a second kneaded product.

The binder is based on polyethylene and composed mainly of polyethylene and polymethyl methacrylate (abbreviated to "PMMA").

At the outset, the first kneaded product comprising an Fe-50% Co alloy was subjected to injection molding to provide a molded article for use as a core 6 portion shown in FIG. 3. The molded article was inserted into a mold for injection molding, and the second kneaded product comprising an Fe-50% Co alloy was injection-molded integrally with the core portion to provide a magnet base 12 comprising a composite molded article.

The binder was removed from the magnet base at a maximum temperature of 435° C., and the magnet base was then sintered in a $H_2$ gas stream at 1400° C. for one hour. As a result, no unfavorable phenomena such as cracking, blistering and deformation were observed in the sintered body.

The magnet base was incorporated in a printer, and the printing speed was compared with that of a magnet base consisting of an Fe-50% Co alloy having a mean particle diameter of 8 μm. As a result, the printing speed was 108 cps, which is substantially identical to the printing speed when the conventional magnet base was used, that is, 110 cps.

The weight of the conventional magnet base was 130 g, whereas the magnet base of the present invention was a reduced value of 120 g. Further, the price of the raw material powder could be reduced by 30%.

EXAMPLE 7

(Example of another application to a magnet base for a wire dot printer)

A magnet base was formed in the same manner as that of Example 4, except that the material was changed.

Specifically, an Fe-6.5% Si alloy was used as the material for forming the core 6, and Fe was used as the material for forming the other portion.

An Fe-6.5% Si alloy powder having a mean particle diameter of 8 μm was kneaded with 40% by volume of a binder by means of a pressure kneading machine to form a first kneaded product.

An Fe powder having a mean particle diameter of 20 μm was kneaded with 38% by volume of a binder by means of a pressure kneading machine to form a second kneaded product.

The binder is based on polyethylene and composed mainly of polyethylene and polymethyl methacrylate (abbreviated to "PMMA").

At the outset, the headed product comprising an Fe-6.5% Si alloy was subjected to injection molding to provide a molded article for use as a core 6 portion shown in FIG. 3. The molded article was inserted into a mold for injection molding, and the kneaded product comprising Fe was injection-molded integrally with the core portion to provide a magnet base 12 comprising a composite molded article.

The binder was removed from the magnet base at a maximum temperature of 435° C., and the magnet base was then sintered in a $H_2$ gas stream at 1400° C. for one hour. As a result, no unfavorable phenomena such as cracking, blistering and deformation were observed in the sintered body.

The magnet base was incorporated in a printer, and the printing speed was compared with that of a magnet base consisting of an Fe-6.5% Si alloy alone. As a result, the printing speed was 69 cps which is substantially identical to the printing speed when the conventional magnet base was used, that is, 70 cps.

Although the weight of the magnet base was 125 g, which was 5% larger than the weight of the conventional magnet base, that is, 119 g, the price of the raw material powder could be reduced by 30%.

Boring and screw cutting could be easily conducted in the portion of Fe.

In the practice of the present invention wherein a composite molded article is formed and sintered, a reduction in weight and a reduction in cost becomes possible, and boring of the sintered body, which was unattainable in the prior art, becomes possible through proper selection of the material.

We claim:

1. A magnetic base comprising:

a first portion, comprising one of a core portion or a core-containing peripheral portion, of an Fe-50% Co alloy; and a second portion integral with the first portion and comprising a magnetic circuit-constituting portion of an Fe-Si alloy.

2. A magnetic base comprising:

a first portion, comprising one of a core portion or a core-containing peripheral portion, of an Fe-6.5% Si alloy; and a second portion integral with the first portion and comprising a magnetic circuit-constituting portion, of an Fe or an Fe-0–3% Si alloy.

3. A magnetic base comprising:

a first portion, comprising one of a core portion or a core-containing peripheral portion, of a sintering density of 90% or more; and a magnetic circuit-constituting portion integral with the first portion and having a sintering density of 80 to 90%.

* * * * *

UNITED STATES PATENT AND TRADEMARK OFFICE

CERTIFICATE OF CORRECTION

PATENT NO. : 5,487,773

DATED : Jan. 30, 1996

INVENTOR(S) : SEYAMA et al.

It is certified that error appears in the above-indentified patent and that said Letters Patent is hereby corrected as shown below:

Col. 1, line 50, change "cost;" to --cost,--.

Col. 3, line 52, after "article" (second occurrence) insert --,--.

Col. 4, line 18, change "their" to --the--.

Col. 7, line 1, change "a," to --a--;
line 49, change "headed" to --kneaded--.

Col. 8, line 8, change "headed" to --kneaded--;
line 10, change "headed" to --kneaded--;
line 64, change "headed" to --kneaded--.

Signed and Sealed this

Sixth Day of August, 1996

*Attest:*

Bruce Lehman

BRUCE LEHMAN

*Attesting Officer*

*Commissioner of Patents and Trademarks*